US011491451B1

(12) United States Patent
Androsch

(10) Patent No.: US 11,491,451 B1
(45) Date of Patent: Nov. 8, 2022

(54) PORTABLE MIXING CONTAINER

(71) Applicant: AlpStories, Inc., Atlanta, GA (US)

(72) Inventor: Astrid Androsch, Atlanta, GA (US)

(73) Assignee: Alpstories Inc, Atlanta, GA (US)

( * ) Notice: Subject to any disclaimer, the term of this patent is extended or adjusted under 35 U.S.C. 154(b) by 0 days.

(21) Appl. No.: 17/720,408

(22) Filed: Apr. 14, 2022

Related U.S. Application Data

(63) Continuation-in-part of application No. 17/696,954, filed on Mar. 17, 2022.

(51) Int. Cl.

| | |
|---|---|
| ***B01F 31/441*** | (2022.01) |
| ***B01F 33/501*** | (2022.01) |
| ***B01F 27/93*** | (2022.01) |
| ***B01F 27/1151*** | (2022.01) |
| ***B01F 31/40*** | (2022.01) |

(52) U.S. Cl.
CPC ..... *B01F 33/50111* (2022.01); *B01F 27/1151* (2022.01); *B01F 27/93* (2022.01); *B01F 31/40* (2022.01)

(58) Field of Classification Search
CPC ..... B01F 31/441
USPC ..... 366/332, 333
See application file for complete search history.

(56) References Cited

U.S. PATENT DOCUMENTS

| | | | | |
|---|---|---|---|---|
| 165,615 | A * | 7/1875 | Redheffer | B01F 31/441 366/256 |
| 813,497 | A * | 2/1906 | Hitchcock | B01F 31/441 366/258 |
| 1,178,744 | A * | 4/1916 | Mitchell | B01F 31/441 366/256 |
| 4,893,729 | A | 1/1990 | Iggulden | |
| 6,402,364 | B1 | 6/2002 | Esclar et al. | |
| 2006/0087915 | A1 | 4/2006 | Koniezko | |
| 2007/0177455 | A1 * | 8/2007 | Renfro | B01F 33/5011 366/207 |
| 2014/0098629 | A1 | 4/2014 | Greter | |
| 2015/0009775 | A1 | 1/2015 | Vogt | |
| 2020/0330939 | A1 * | 10/2020 | Wetter | B01F 35/146 |

FOREIGN PATENT DOCUMENTS

| | | | |
|---|---|---|---|
| DE | 19647617 | A1 | 11/1996 |

* cited by examiner

*Primary Examiner* — David L Sorkin
(74) *Attorney, Agent, or Firm* — Gugliotta & Gugliotta LPA

(57) ABSTRACT

A capped retail dispenser package encloses and retains a mixing container into which a product mixture is filled using an automated manufacturing system in an individualized manner, such that each individual product container may be charged with a customized or unique formulation different than a previous or subsequent container passing through the system. Mixing is not done prior to filling, but with a mixer received in a slidable bottom portion that functions as a piston. The rod terminates at its upper end with a mixing plate. Movement of the rod through the central opening provides mixing of the product through a reciprocating motion, and preferably with a simultaneous rotation. Movement of the upper mixing plate within the mixing container provides mixing of the container's contents by forcing fluid flow through one or more mixing apertures formed about a flange of the mixing plate.

16 Claims, 4 Drawing Sheets

PORTABLE MIXING CONTAINER

1. FIELD OF THE INVENTION

The present invention relates generally to dispensing containers for consumer products and, more particularly, to a retail package that provides for in-situ mixing of flowable contents with an integrated mixing system and a process for preparation of the mixed product using the said container.

2. BACKGROUND OF THE RELATED ART AND THE TECHNICAL PROBLEM

Most health or beauty products (i.e., personal care, cosmetics, medicaments, vitamins, sports drinks, etc.) are designed, formulated and packaged in a manner intended to be in contact with outer parts of human body and, as such, are regulated during manufacture and use for health and safety of consumers. Preparation of such products is generally be carried out in a where components are mixed or blended, and then packaged for individual consumer use. The tracking of components and manufacturing information (e.g., lot number, expiration dating, manufacturing location, etc.) is regulated to facilitate safety recalls in the event of adverse events. Similarly, product packaging may also require certain minimum consumer information (e.g., quantity/dosage, active and inactive ingredients, warnings, etc.).

While the tracking and packaging requirements may be common to most consumable consumer products, there is a wide variation the properties of any of the various individual ingredients. Variations in rheological properties, such as viscosity and density, are often the most challenging hurdles to the full and proper mixing or blending where the aim is equal distribution without degradation of the components, wherein contamination of the product has to be prevented. Given the combination of tracking requirements and quality/blending challenges, the blending of individual packaged doses could allow for improved ease and consistency of manufacturing and distribution.

There are several different systems and methods that are known for use in the preparation of health and beauty or similar products that are directed to improved or simplified systems for formulation and production. Of particular importance is U.S. Pat. No. 4,893,729, issued in the name of Iggulden et al., which discloses a selectable mixing bottle that holds, mixes, and dispenses a mixture of two liquid components directly in a plastic bottle having two compartments, each containing a respective liquid component. Concentric bores in disposed in the neck of the bottle communicate ingredients into a mixing compartment. A threaded cap can adjust the size of at least one bore to adjust a quantity of an ingredient so that proportions of mixed components may be created to adjust the consistency of the mixture that passes over said second bore as said selector dial is rotated on said neck whereby the quantity of said active ingredient and thereby the quality of dispensed quantities of mixtures of said lotion and said active ingredient are adjustable.

Also of considerable importance is U.S. Pat. No. 6,402,364, issued in the name of Esclar et al. Here a portable dispenser is provided having at least two containers filled with substances of different colors, each discharging into a mixing chamber where the substances can be mixed together to form a cosmetic composition. A stirrer is provided movable in the mixing chamber, and the mixing chamber is organized to enable the user to observe the color of the resulting mixture prior to extracting it.

While each of these examples allow post-production mixing or blending to occur by the consumer in order to adjust the character of the dispensed product, neither are very well suited for widespread product of a product, or particularly to production that can allow for unit-by-unit customization of a product formula. To accomplish such a goal, a container would be required that would allow for complete mixing of filled contents, even when ingredients have high viscosity or require a mechanical mixing aid to facilitate solvating solid components.

Consequently, an improved retail package that provides for in situ mixing of flowable contents with an integrated mixing system can overcome the above limitations. Such a solution could further facilitate an improved process for production of such mixed products.

SUMMARY OF THE INVENTION

It is an object of the present invention to provide for a new and unique retail package design that provides for in-situ mixing of flowable contents.

It is a feature of the present invention to facilitate an improved process for production of such mixed products.

Briefly described according to a preferred embodiment, a product container is provided having an outer housing forming a retail dispenser package having central outer housing body forming a substantial portion of the outer housing. The central outer housing body is closed at a lower terminus by a lower housing end cap. The central outer housing body is closed at an upper terminus by a closure cap. A mixing container is retained within the outer housing, into which a multi-component mixture is filled. Additionally, it is envisioned that a homogenous flowable formulation, especially one that may benefit from blending or mixing, may be utilized. The mixture may be filled using an automated manufacturing system in an individualized manner, such that each individual product container may be charged with a customized or unique formulation different than a previous or subsequent container passing through the system. Such filling eliminates the need for mixing or blending prior to filling. The mixing container may form an upper access opening for receiving the product to be prepared, and an open lowered end for receiving a slidable bottom portion. The bottom portion functions as a piston that forms a central opening for receiving a rod, and an outer circumference adapted to fully seal the lower end. The rod terminates at its upper end with a mixing plate. Movement of the rod through the central opening provides mixing of the product through a reciprocating motion, and preferably with a simultaneous rotation. Movement of the slidable bottom portion upward into the mixing container may seal the contents therein. Movement of the upper mixing plate within the mixing container may provide mixing of the container's contents by forcing fluid flow through one or more mixing apertures formed about a flange of the mixing plate.

It is an advantage of the present invention to allow for in-situ mixing of flowable contents with the mixing container. The presence of a mixing container can further accommodate any number of product formulations, from topical agents for hair, skin, or nails, to medicaments, vitamins or supplements, to nutritional products, sports or energy drinks, etc. By providing a mixer integral within a final packaging, mixing within the sealed volume eliminates waste generation and controls the conditions during mixing to reduce possible contamination. Such a use is further adaptable for use with mixed pharmaceutical products, particularly those requiring dosing adjustments based on a prescription.

It is an advantage of the movable bottom portion and slidable rod within the mixing container to allow for thorough and complete mixing the product contents. Thorough mixing accomplished within the container allows filling of ingredients within each container to be accomplished independently, further facilitating a customizable product formulation. Further still, the configuration of the mixing plate, including the number, size and placement of mixing orifices, can further allow for product formulations using components whose blending may be difficult such as, for example, high viscosity liquids, non-Newtonian fluids or liquid-solid solutions.

It is an advantage of the simultaneous reciprocal and rotational motions of the mixer to provide greater efficiency, as compared to mixing using only one plane of motion. A significant decrease in mixing time may be achieved by providing a mixing rotation in one direction, and the ability to remove air or create a vacuum within the mixing chamber may further ensure good mixing and reduce or eliminate entrained air in the prepared product.

Further, advantages of using an outer housing forming a retail dispenser package to completely contain the inner mixing chamber allows for a discrete use of the mixing chamber within a consumer-facing packaging (e.g., retail packing including required product-identifying information). Such an arrangement may be configured in any number of ornamental or industrial designs, colors and/or materials.

Further objects, features, elements, and advantages of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
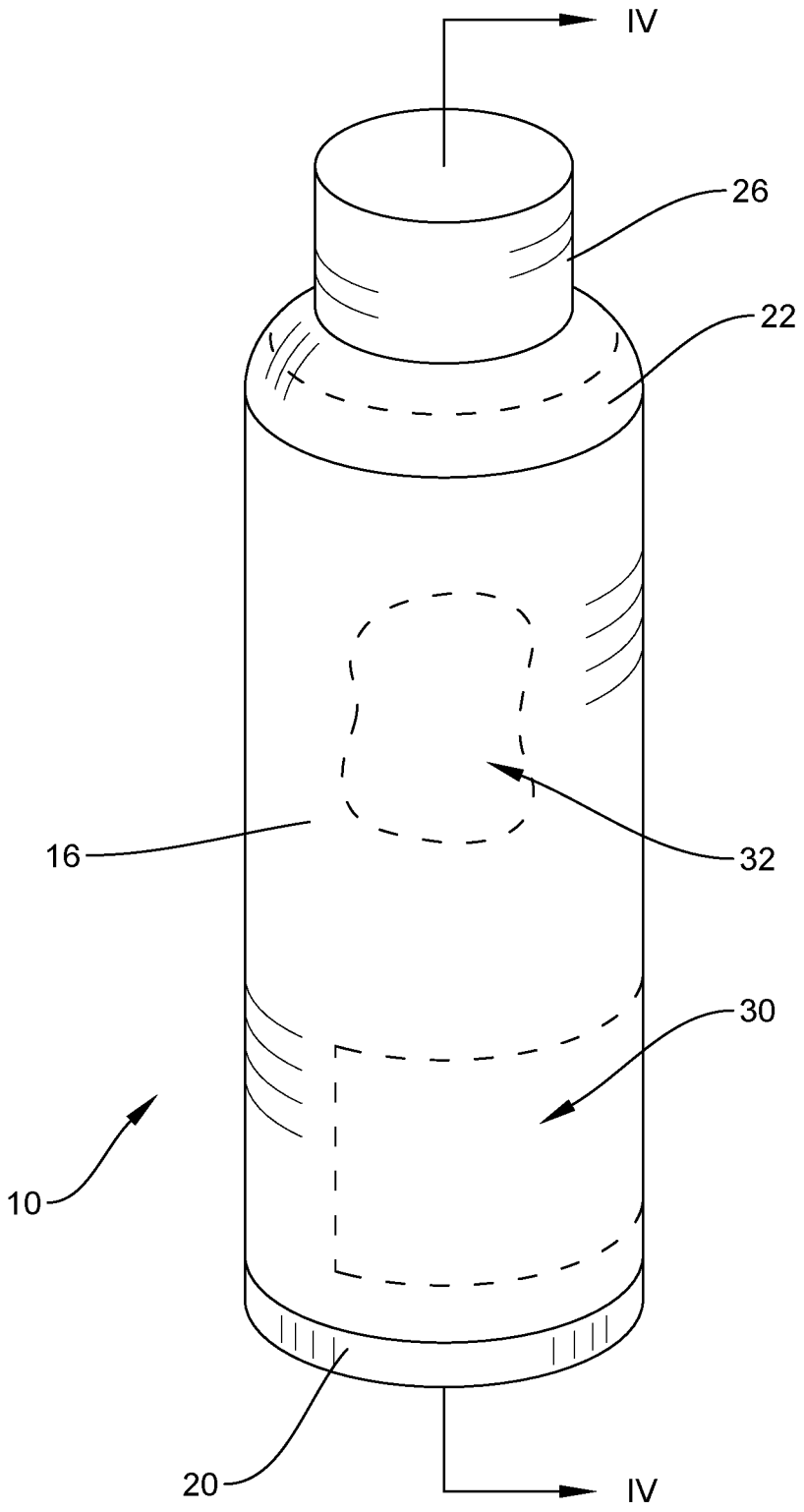
FIG. 1 is a perspective view of a container with an integrated mixing system according to the preferred embodiment of the present invention.
Figure 2:
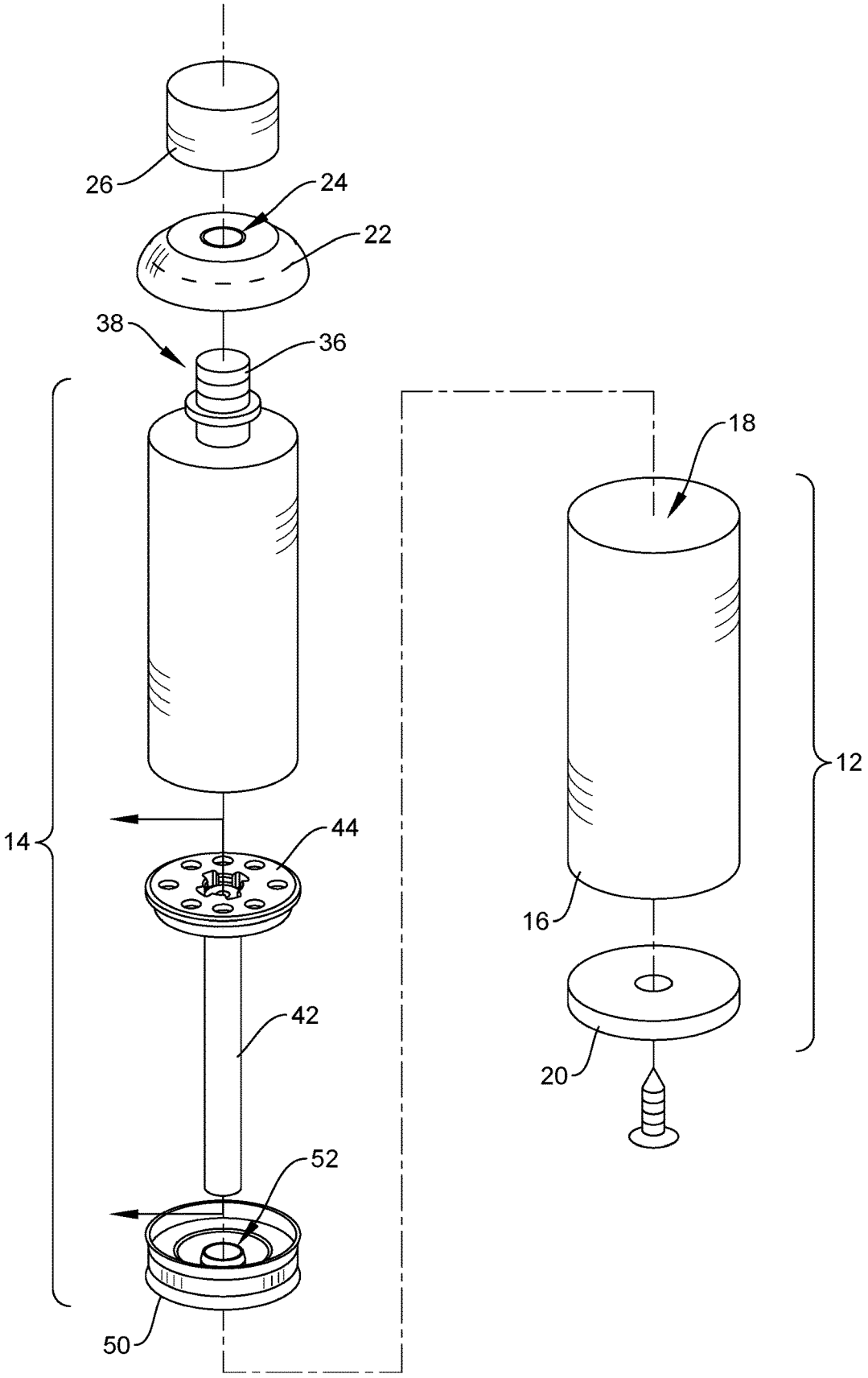
FIG. 2 is an exploded perspective view thereof.

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, which is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112(f).

1. DETAILED DESCRIPTION OF THE FIGURES

Referring now to the drawings, wherein like reference numerals indicate the same parts throughout the several views, a portable mixing container, generally noted as 10, is shown according to a preferred embodiment of the present invention. The container 10 comprises, essentially, an outer housing 12 and a mixing container insert (or mixing insert) 14.

The outer housing 12 may be formed of a central outer housing body 16 circumscribing a volume 18 into which the mixing container insert 14 is received. The volume 18 may be closed at a lower terminus by a lower housing end 20. The volume 18 may further be closed at an upper terminus by an upper housing end 22. The upper housing end 22 may form a volume egress port 24 through which the mixing insert 14 may protrude, as described in greater detail below. A removable, replaceable closure cap 26 may further seal the volume 18 and insert 14 when affixed to the upper terminus.

The outer housing 12 may form a retail dispenser package within consumer-facing packaging. Such retail packaging may include any desired or required product-identifying information 30 or any branding 32. The branding 32 and overall configuration of the outer housing 12 may be of any number of ornamental or industrial designs, colors and/or materials. In a preferred embodiment the mixing insert 14 may be of a standard configuration for use with any number of a variety of designs or configurations of outer housing 12, whether for different products, different brands or the like.

The mixing container insert 14 is retained within the outer housing 12. The mixing container 14 may form the containment volume 34 into which the ultimate product is filled. According to a preferred embodiment, the product 36 may be a homogenous flowable formulation, especially one that may benefit from blending or mixing, may be utilized. According to a more preferred embodiment, the product (not shown for clarity) may be formed of a multicomponent mixture. In any preferred embodiment the product may preferably be a health product or beauty product or their equivalently, include any topical agent for hair, skin, or nails, as well as medicaments, vitamins, supplements, nutritional products, sports or energy drinks or any similar or equivalent consumer product. Further, in any embodiment the product may be personalized or customized and/or made-to-order, construe as broadly and functionally equivalently as reasonable.

The mixing container insert 14 may form a nozzle or opening 36 for receiving components of the products during filling and for dispensing product when required. The nozzle 36 may extend through the volume egress port 24. The nozzle 36 may form a threaded connection 38 for receiving the cap 26.

The mixing container insert 14 further may receive a reciprocating mixer 40. The mixer 40 may comprise a shaft 42 terminating at one end with an affixed mixing flange or mixing plate 44. The mixing plate 44 may form one or more mixing apertures 46. The shaft 42 may be rigidly affixed to a lower surface of the mixing plate 44. The shaft 44 may be generally cylindrical and solid. In an alternate configuration, the shaft 44 may form a hollow inner conduit exiting at an additional mixing aperture (not shown) to provide additional paths for fluid flow.

According to a preferred embodiment the mixing plate 44 may be provided with equally distributed mixing apertures 46. As described in greater detail below, the operation of the mixing plate 44 may provide a reciprocating motion, urged by the shaft 42, through the product contained within the insert 14. According to a more preferred embodiment, the shaft 42 may further impart a rotational motion about the mixing plate 44 during reciprocation. In a preferred embodiment, the reciprocal motion of the mixer may have a speed of at least 0.2 meters per second, and more preferably at least 1 meter per second, wherein the speed may be altered during mixing. Movement of the plate 44 through the contents ensures intensive, fast, and efficient mixing of the components by forcing liquid through the apertures 46.

The bottom of the insert 14 may be sealed with an insert 12 is a movable piston 50, which may seal the lower portion of the insert 14. The piston 50 may further form an opening 52 through which the shaft 42 may be inserted and installed.

Figure 3:
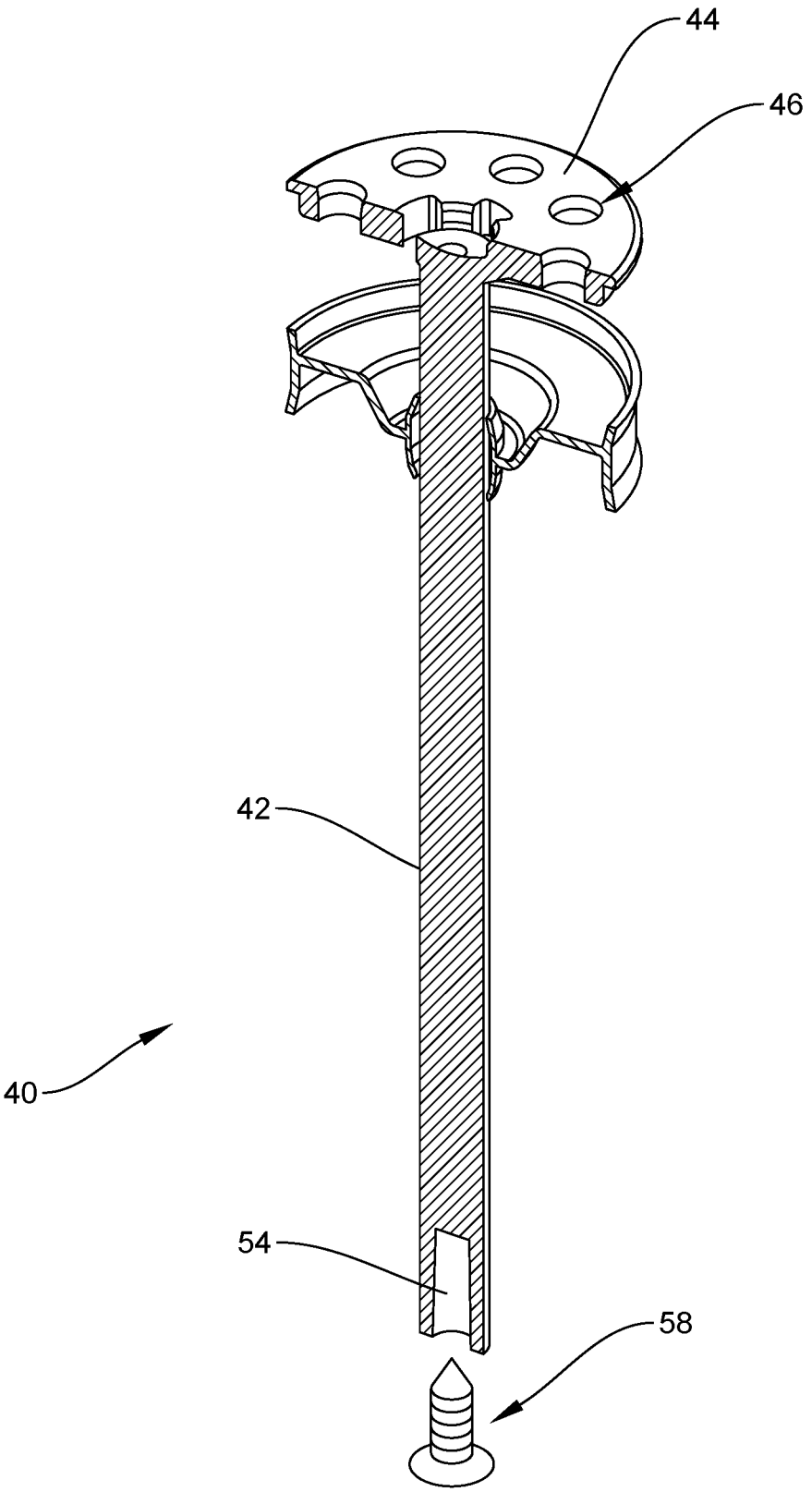
FIG. 3 is a cross sectional view of the mixer and the sealing piston taken along line III-Ill of FIG. 2.
Figure 4:
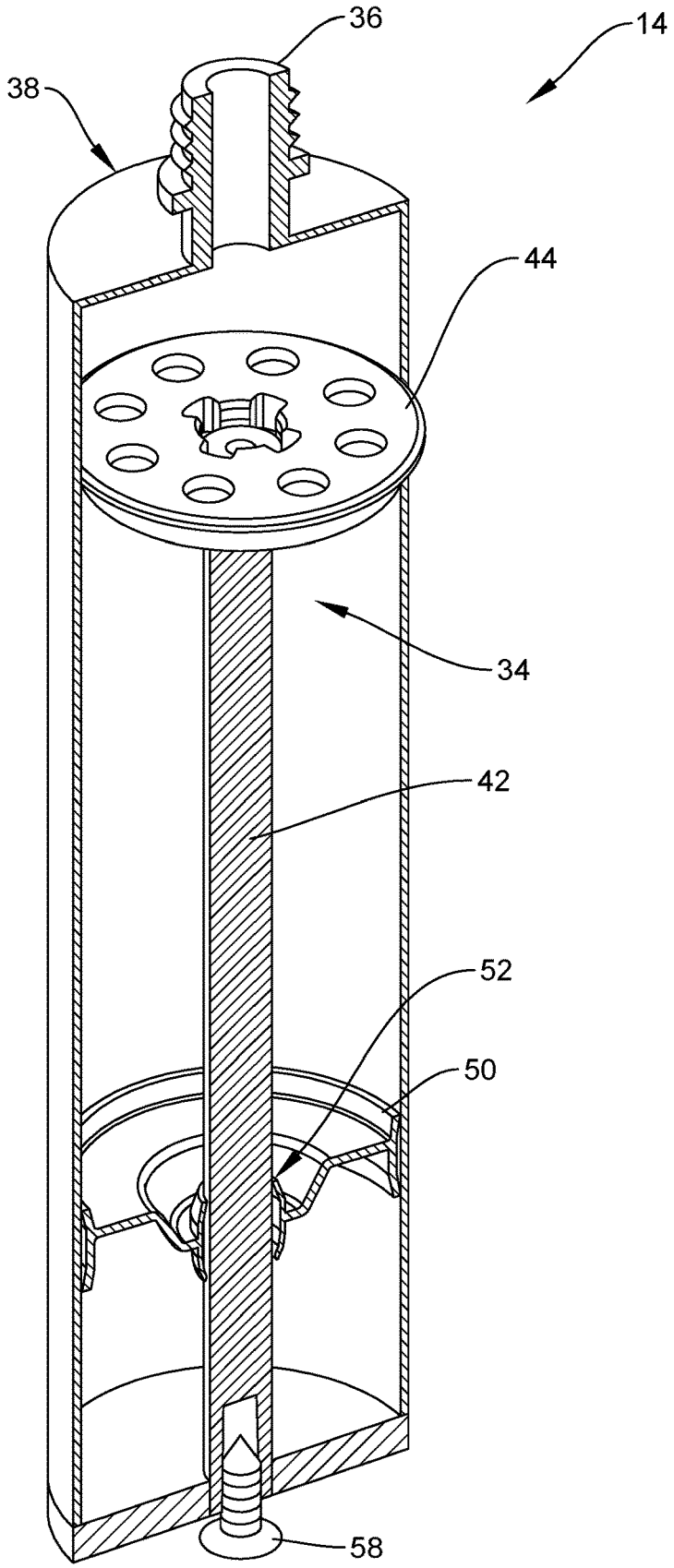
FIG. 4 is a cross sectional view taken along line IV-IV of FIG. 1.

As best shown in conjunction with FIG. 3, the shaft 42 may terminate at its lower end by forming an opening 54 for attachment to a screw 58. The screw 58 with which the rod 42 is moved. The screw 58 may provide a connection point for reciprocation and rotation of the shaft 44 in order to facilitate mixing.

2. OPERATION OF THE PREFERRED EMBODIMENT

In operation the present system a mixture may be filled into the mixing container 14 via an automated manufacturing system in an individualized manner, such that each individual product container may be charged with a customized or unique formulation different than a previous or subsequent container passing through the manufacturing system without the need for mixing or blending prior to filling. The slidable bottom portion may function as a piston that forms both retains the shaft of the mixer as well fully sealing the lower end. The bottom portion may be urged upward to discharge any excess air or urged downward to create a vacuum. The movement of the shaft through the central opening provides mixing of the product through a reciprocating motion, and preferably with a simultaneous rotation. Movement of the upper mixing plate within the mixing container may provide mixing of the container's contents by forcing fluid flow through one or more holes formed about a body of the mixing plate.

The use of such in-situ mixing container may provide for a scalable business making customized products using a one or a large number of ingredients with rapid reconfiguration for high-speed manufacturing. High speed, autonomous on-demand production may enable made-to-order formulae that are affordable and a business that can be scaled benefiting the consumer as well as the health, beauty, medical, food, and other related industries. A scalable and autonomous on-demand production for made-to-order skincare products allows for a unique formula for each single consumer. A complete end-to-end technology solution for made-to-order beauty care and health products enabling consumers to mix their own formula to create a customized beauty product for their individual needs as well as enabling private label customers to rapidly create their own beauty care, nutrition or health product line (and own brand) without the financial burden of minimum order quantities and lengthy formulation processes.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples, and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein but is to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of *Warner-Jenkinson Company, v. Hilton Davis Chemical,* 520 US 17 (1997) or *Festo Corp. v. Shoketsu Kinzoku Kogyo Kabushiki Co.,* 535 U.S. 722 (2002), or other similar caselaw or subsequent precedent should not be made if any future claims are added or amended subsequent to this Patent Application.

I claim:

1. A product container comprising:

a closure cap;

an outer housing forming a retail dispenser package having central outer housing body forming a substantial portion of the outer housing;

the central outer housing being closed at a lower terminus by a lower housing end cap and closed at an upper terminus by the closure cap;

a mixing container retained within the outer housing into which product mixture is filled, said mixing container forms an upper access opening for receiving the product mixture, a central mixing volume, and an open lower end receiving a slidable bottom portion;

the slideable bottom portion comprises:

a central opening receiving a rod, and an outer circumference sealing the lower end;

the rod terminates at its upper end with a mixing plate, said mixing plate having a flange radially extended from the rod and forming at least one mixing aperture formed about the flange; wherein movement of the rod through the central opening seals the content and movement of the mixing plate through the central mixing volume mixes the product mixture.

2. The product container of claim 1, wherein movement of said rod creates a mixing motion selected from a group consisting of: a reciprocating motion; a rotational motion; and a simultaneous reciprocating and rotational motion.

3. The product container of claim 2, wherein a rotational motion is in one direction.

4. The product container of claim 2, wherein the product mixture comprises a homogenous flowable formulation, said product mixture filled using an automated manufacturing system in an individualized manner such that each individual product container is capable of being charged with a customized or unique formulation without mixing or blending prior to charging.

5. The product container of claim 2, wherein the product mixture comprises a multi-component blended or mixed flow able formulation a homogenous flowable formulation, said product mixture filled using an automated manufacturing system in an individualized manner such that each individual product container is capable of being charged with a customized or unique formulation without mixing or blending prior to charging.

6. The product container of claim 2, wherein said rotational motion rotates the flange about the rod at a mixing speed with rotational movement is from 1 rotation per second to 10 rotations per second.

7. The product container of claim 2, wherein said reciprocal motion has a speed of at least 0.2 meters per second, and wherein the speed may be altered during mixing.

8. The product container of claim 6, wherein said reciprocal motion has a speed of at least 0.2 meters per second, and wherein the speed may be altered during mixing.

9. The product container of claim 2, wherein said flange has a diameter of between about 2 mm to about 8 mm.

10. The product container of claim 2, wherein said flange and said rod form a single uniform piece.

11. The product container of claim 2, wherein said at least one mixing aperture has a diameter from between about 0.2 mm to about 0.8 mm.

12. The product container of claim 11, wherein said at least one mixing aperture is positioned in an outer part of the flange.

13. The product container of claim 2, wherein said at least one mixing aperture comprises a plurality of mixing apertures.

14. The product container of claim 13, wherein said flange has a diameter of between about 2 mm to about 8 mm.

15. The product container of claim 13, wherein said flange and said rod form a single uniform piece.

16. The product container of claim 13, wherein said plurality of apertures each have a diameter from between about 0.2 mm to about 0.8 mm.

* * * * *